US008898972B2

(12) United States Patent
Chen

(10) Patent No.: US 8,898,972 B2
(45) Date of Patent: Dec. 2, 2014

(54) QUICK ASSEMBLING FLOOR MAT AND COMPONENTS THEREOF

(71) Applicant: Singform Enterprise Co., Ltd., Putze, Chia-Yi County (TW)

(72) Inventor: Shih Wen Chen, Putze (TW)

(73) Assignee: Singform Enterprise Co., Ltd., Putze (TW)

( * ) Notice: Subject to any disclaimer, the term of this patent is extended or adjusted under 35 U.S.C. 154(b) by 0 days.

(21) Appl. No.: 13/889,429

(22) Filed: May 8, 2013

(65) Prior Publication Data

US 2013/0298483 A1 Nov. 14, 2013

(30) Foreign Application Priority Data

May 11, 2012 (TW) ..... 101116799 A

(51) Int. Cl.
*E04F 11/16* (2006.01)
*E04F 15/00* (2006.01)
*E04F 15/02* (2006.01)

(52) U.S. Cl.
CPC ..... *E04F 15/02161* (2013.01)
USPC ..... 52/177; 52/181

(58) Field of Classification Search
CPC ..... E04F 15/10; E04F 15/02; E04F 19/065; E01C 5/20; B32B 1/00
USPC ..... 52/177, 181, 459, 586.1, 585.1, 586.2, 52/588.1; 15/215, 216, 238–240
See application file for complete search history.

(56) References Cited

U.S. PATENT DOCUMENTS

| | | | | | |
|---|---|---|---|---|---|
| 3,238,554 | A | * | 3/1966 | Mann, Jr. | 15/217 |
| 4,029,834 | A | * | 6/1977 | Bartlett | 428/62 |
| RE32,061 | E | * | 1/1986 | Ellingson, Jr. | 425/52 |
| 4,654,245 | A | * | 3/1987 | Balzer et al. | 428/52 |
| 4,663,903 | A | * | 5/1987 | Ellingson, Jr. | 52/181 |
| 4,675,222 | A | * | 6/1987 | Berndt, Jr. | 428/53 |
| 4,804,570 | A | * | 2/1989 | Bedics | 428/53 |
| 4,879,151 | A | * | 11/1989 | Ellingson, Jr. | 428/53 |
| 5,157,804 | A | * | 10/1992 | Williams | 15/161 |
| 5,486,392 | A | * | 1/1996 | Green | 428/54 |

* cited by examiner

*Primary Examiner* — Brian Glessner
*Assistant Examiner* — Paolo Agudelo
(74) *Attorney, Agent, or Firm* — Alan Kamrath; Kamrath IP Lawfirm, P.A.

(57) ABSTRACT

A quick assembling floor mat has multiple reinforced plastic bars and multiple connecting strips. Each reinforced plastic bar has a body, a mounting seat formed on the top surface of the body, at least one metal reinforcing sheet mounted in the body to enhance the structural strength of the body and two connecting grooves respectively formed in the sidewalls of the body. Each one of the connecting strips is connected to two adjacent reinforced plastic bars and has two enlarged ends respectively formed on and protruding from the sides of the connecting strip and corresponding to the connecting grooves of the two adjacent reinforced plastic bars. The reinforced plastic bars only use a small amount of a metal material to reinforce, and this can reduce the cost of materials and can maintain the rigidity and the intensity of the quick assembling floor mat.

16 Claims, 11 Drawing Sheets

QUICK ASSEMBLING FLOOR MAT AND COMPONENTS THEREOF

BACKGROUND OF THE INVENTION

1. Field of Invention

The present invention relates to a floor mat and, more particularly, to a quick assembling floor mat and components thereof that can be assembled quickly and having a preferred structural strength.

2. Description of the Related Art

In order to maintain cleanliness of the interior of general public places such as department stores, office buildings, medical facilities, train stations and the like, a conventional floor mat is usually placed on the floor in front of the entrance of a building. Due to durability considerations, a conventional aluminum mud-scraping mat is frequently used. The conventional aluminum mud-scraping mat is partially embedded in the floor and has multiple aluminum skeletons and multiple mud-scraping bars respectively mounted on the surfaces of the aluminum skeletons. The structural strength of the aluminum skeletons can provide the conventional aluminum mud-scraping mat with excellent durability.

However, the conventional aluminum mud-scraping mat has the following shortcomings.

1. Aluminum is used to increase the structural strength of the conventional aluminum mud-scraping mat, and this will increase the cost of manufacturing the conventional aluminum mud-scraping mat.

2. The aluminum skeletons are normally connected to each other by steel cables. Thus, the conventional aluminum mud-scraping mat cannot be rolled for storage, and this will limit the use of the conventional aluminum mud-scraping mat.

3. The aluminum skeletons are not easily cut to desired lengths which lead to troubles in assembly.

4. When the aluminum skeletons are connected by steel cables, the user cannot change a damaged aluminum skeleton with a new one conveniently and may increase the cost for maintenance.

The present invention provides a quick assembling floor mat and components thereof to obviate or mitigate the shortcomings of the conventional aluminum mud-scraping mat.

SUMMARY OF THE INVENTION

The primary objective of the present invention is to provide a quick assembling floor mat and components thereof that can be assembled quickly and having a preferred structural strength.

The quick assembling floor mat has multiple reinforced plastic bars and multiple connecting strips. Each reinforced plastic bar has a body, a mounting seat formed on the top surface of the body, at least one metal reinforced sheet mounted in the body to enhance the structural strength of the body, and two connecting grooves respectively formed in the sidewalls of the body. Each one of the connecting strips is connected to two adjacent reinforced plastic bars and has two enlarged ends respectively formed on and protruding from the sides of the connecting strip and corresponding to the connecting grooves of the two adjacent reinforced plastic bars. The reinforced plastic bars in the present invention only use a small amount of a metal material to reinforce, and the combination of the reinforced plastic bars and the metal reinforced sheet can reduce the cost of materials and can maintain the rigidity and the intensity of the quick assembling floor mat.

Other objectives, advantages and novel features of the invention will become more apparent from the following detailed description when taken in conjunction with the accompanying drawings.

DETAILED DESCRIPTION OF THE INVENTION

Figure 1:
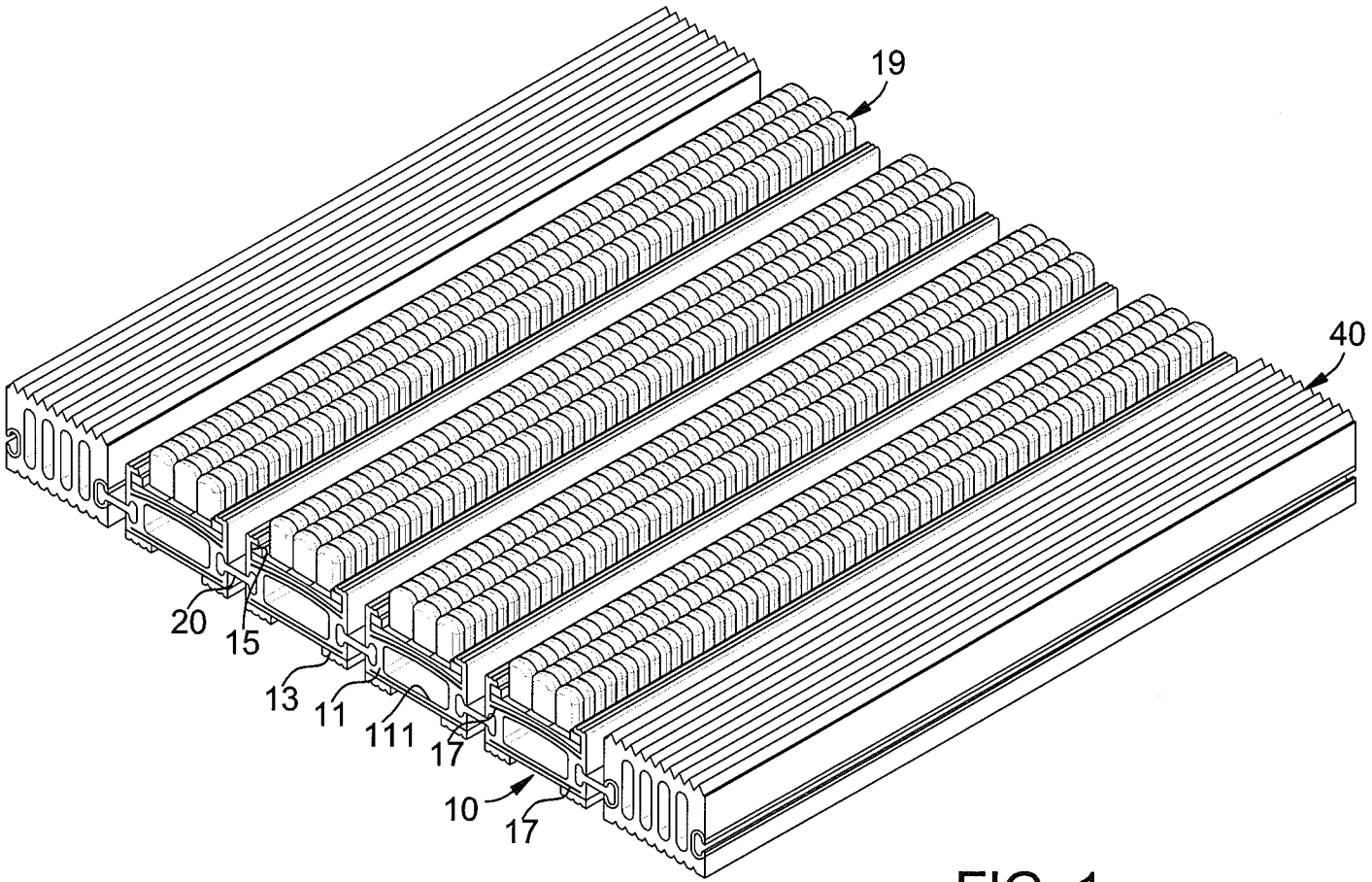
FIG. 1 is a perspective view of a first embodiment of a quick assembling floor mat in accordance with the present invention.
Figure 2:
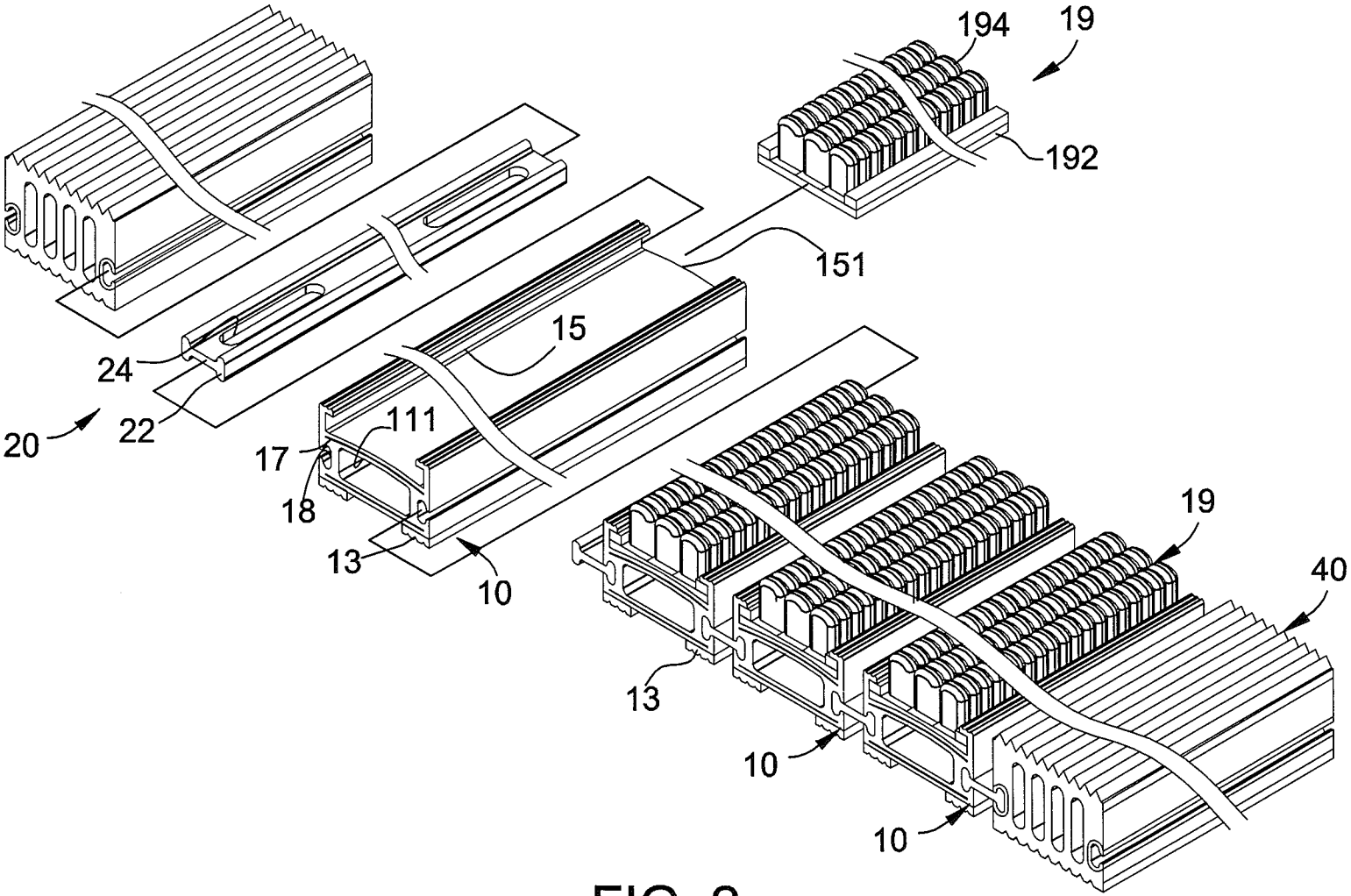
FIG. 2 is an enlarged and exploded perspective view of the quick assembling floor mat in FIG. 1.
Figure 3:
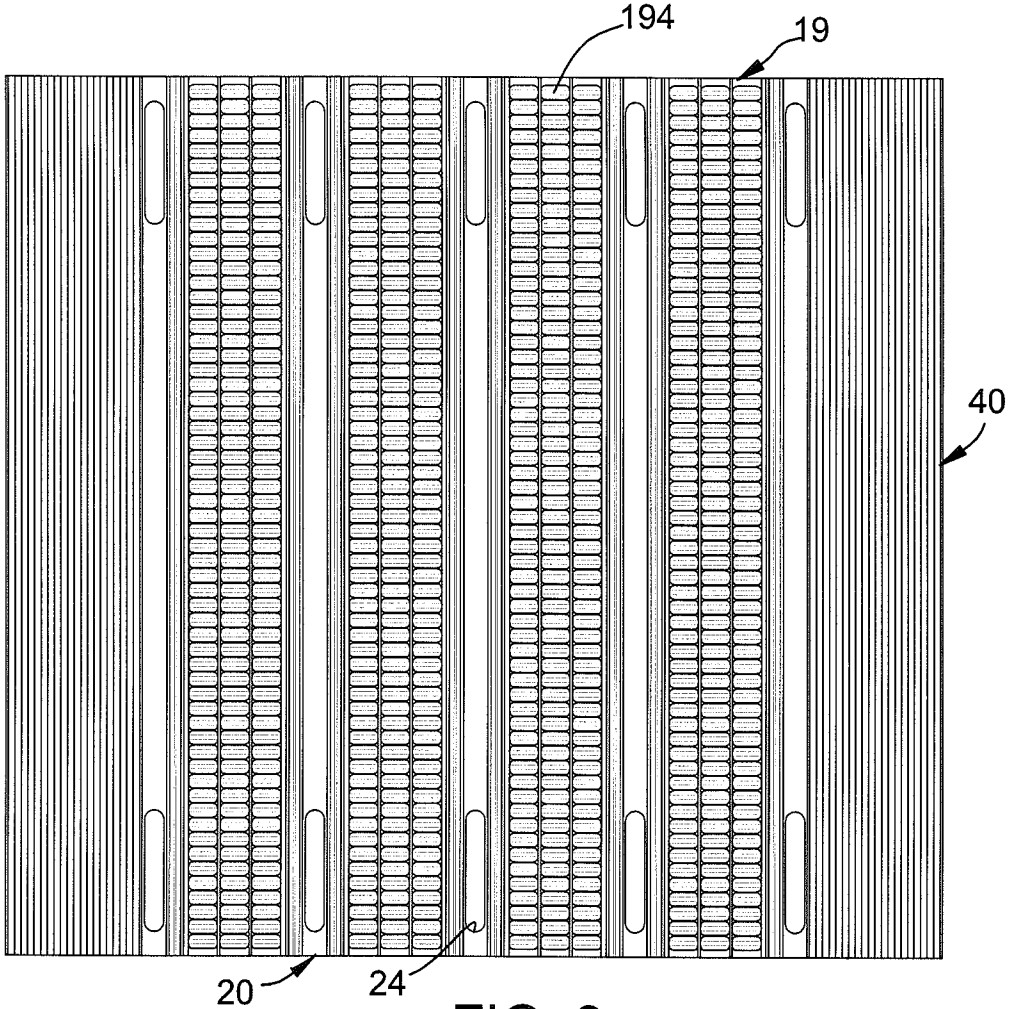
FIG. 3 is an enlarged top view of the quick assembling floor mat in FIG. 1.

With reference to FIGS. 1 to 4, a first embodiment of a quick assembling floor mat and components thereof in accordance with the present invention comprises multiple reinforced plastic bars 10, multiple connecting strips 20 and at least one sealing bar 40.

Each reinforced plastic bar 10 has a body 11, at least one sound-absorbing layer 13, a mounting seat 15, at least one metal reinforcing sheet 17, at least one connecting groove 18 and a contact layer 19. The body 11 is rectangular in cross-section and has a length, a bottom surface, a top surface, two sidewalls and a through chamber 111. The through chamber 111 is formed through the body 11 between the top surface, the bottom surface and the sidewalls of the body 11.

The at least one sound-absorbing layer 13 is securely mounted on the bottom surface of the body 11. The at least one sound-absorbing layer 13 is mounted on the body 11 by bonding, engagement or integrally molding. Preferably, each reinforced plastic bar 10 has two sound-absorbing layers 13 mounted on the bottom surface of the body 11 at an interval. Each sound-absorbing layer 13 is bar-shaped and is formed on the body 11 integrally via an extruding process. The sound-absorbing layers 13 with different hardness may be integrally formed with the body 11 by design of a die of an extruder. Preferably, the hardness of the sound-absorbing layer 13 is softer than the hardness of the body 11 to improve comfort in use.

Figure 4:
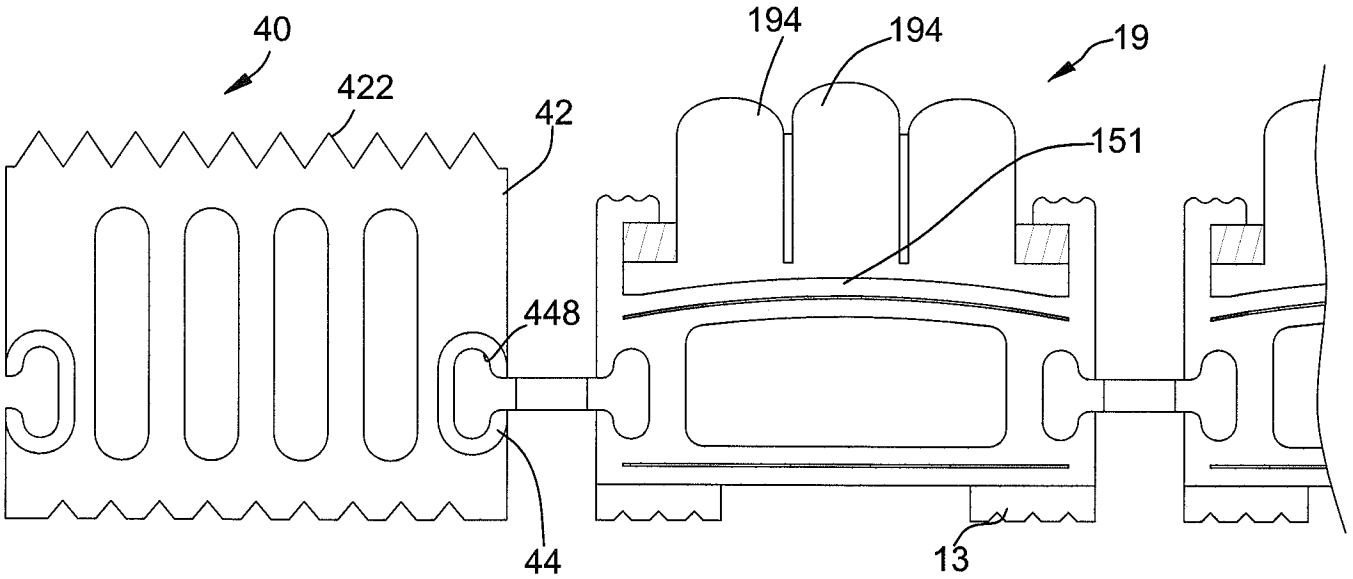
FIG. 4 is an enlarged cross sectional side view of a first embodiment of a reinforced plastic bar and a sealing bar of the quick assembling floor mat in FIG. 1.

The mounting seat 15 is formed on the top surface of the body 11. Preferably, the mounting seat 15 is U-shaped in cross-section and includes a bottom surface, a middle section and a protruding segment 151. The protruding segment 151 is formed on and protrudes from the bottom surface of the mounting seat 15 at the middle section of the mounting seat 15 as shown in FIG. 4.

The at least one metal reinforcing sheet 17 is mounted in the body 11 to enhance the structural strength of the body 11. Then, the whole structural strength of the reinforced plastic bar 10 can be improved. When using the reinforced plastic bar 10 to form a mat product, the at least one metal reinforcing sheet 17 mounted in the body 11 can enable the reinforced plastic bar 10 to have the rigidity and strength as the aluminum skeleton of the conventional aluminum mud-scraping mat, and also can reduce the cost of manufacture. In addition, the convenience of manufacturing the reinforced plastic bar 10 is better than the manufacture of the aluminum skeleton of the conventional aluminum mud-scraping mat.

Due to the above-mentioned features, the durability and the convenience of the quick assembling floor mat can be improved. In addition, the location and the size of the at least one metal reinforcing sheet 17 relative to the body 11 is designed by a mechanic principle (principle of I Beam) to provide the reinforced plastic bar 10 with the strongest structural reinforcement. Furthermore, the at least one metal reinforcing sheet 17 also can improve the stability of the reinforced plastic bar 10.

Preferably, each reinforced plastic bar 10 has two metal reinforcing sheets 17 mounted in the body 11 beside the through chamber 111, and each metal reinforcing sheet 17 is an aluminum sheet or an aluminum alloy sheet. The metal reinforcing sheets 17 are integrally mounted in the body 11 to form a single piece by extruding to provide a preferred strength to the reinforced plastic bar 10. Preferably, one of the metal reinforcing sheets 17 is curved corresponding to the middle section of the mounting seat 15 to form the protruding segment 151 of the mounting seat 15 via the extruding process as shown in FIG. 4.

Figure 5A:
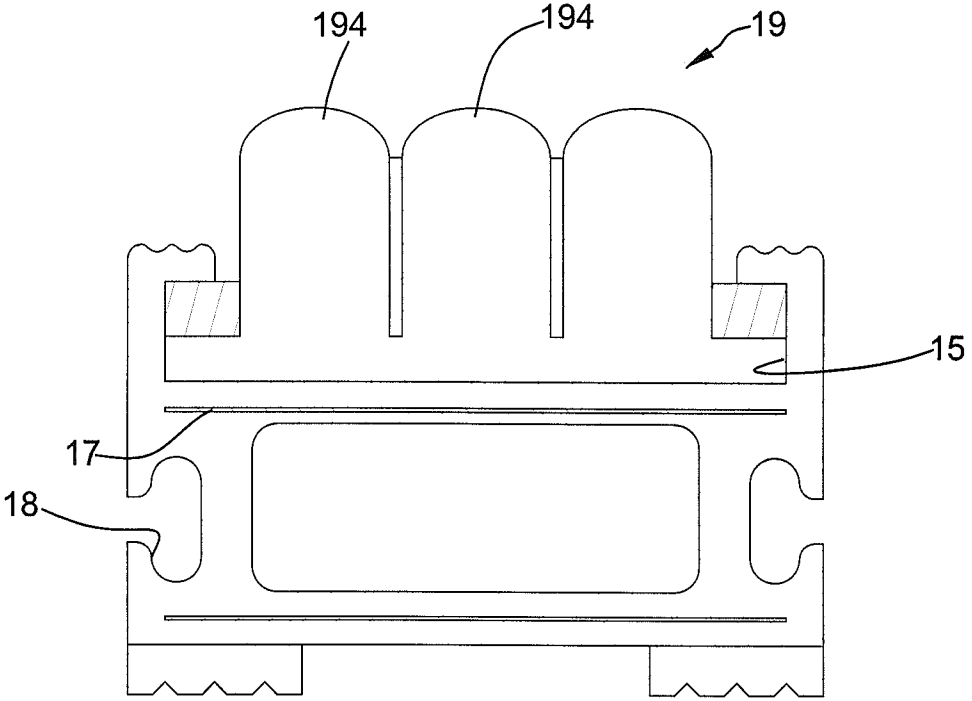
FIG. 5A is an enlarged cross sectional side view of a second embodiment of a reinforced plastic bar of the quick assembling floor mat in accordance with the present invention.
Figure 5B:
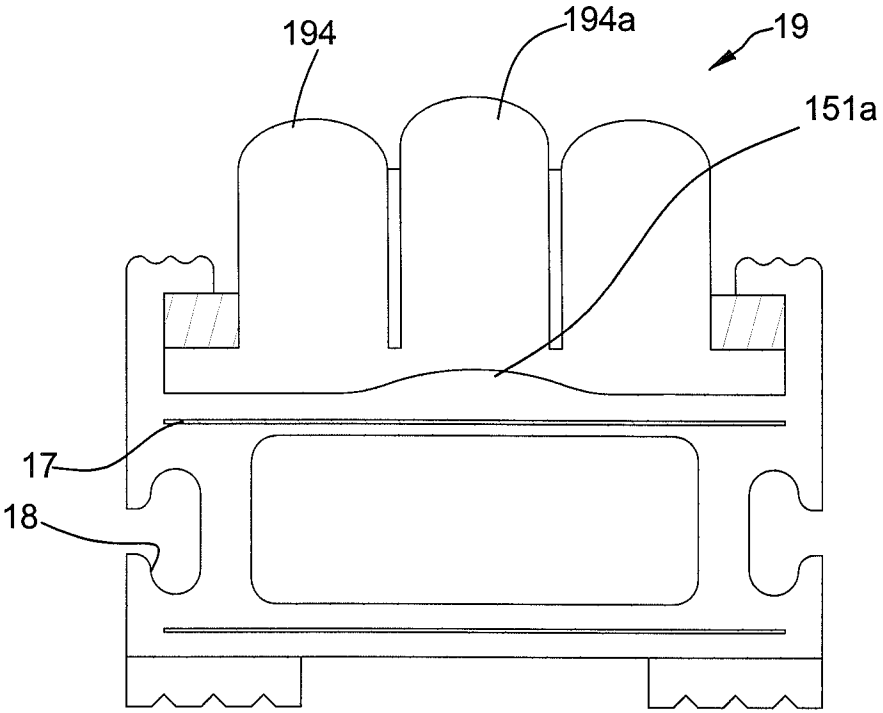
FIG. 5B is an enlarged cross sectional side view of a third embodiment of a reinforced plastic bar of the quick assembling floor mat in accordance with the present invention.

Additionally, with referenced to FIGS. 5A and 5B, the forming type of the protruding segment 151 is not limited, but it can be formed by the curved metal reinforcing sheet 17 or can be formed by a mold used to manufacture the body 11 to thicken the middle section of the mounting seat 15 to form the protruding segment 151*a*.

The at least one connecting groove 18 is formed in one of the sidewalls of the body 11 and has a mouth and a length corresponding to or shorter than the length of the body 11. The mouth is formed through the corresponding sidewall of the body 11 and communicates with the at least one connecting groove 18 to enable the at least one connecting groove 18 to holding an object. Preferably, each reinforced plastic bar 10 has two connecting grooves 18 respectively formed in the sidewalls of the body 11.

The contact layer 19 is rough, is detachably mounted in the mounting seat 15 and has a length corresponding to the length of the body 11, a base 192 and a contacting segment 194. In addition, the material of the contact layer 19 can be carpet, non-woven cloth, rubber, foam cushioning material, metal, or a plastic brush. When a user's sole contacts with the contact layer 19, the rough surface of the contact layer 19 can scrape the soil or dirt on the sole to provide a cleaning effect to the quick assembling floor mat. The base 192 is movably mounted in the mounting seat 15, abuts the protruding segment 151, 151*a* and has a top face and a shape corresponding to the mounting seat 15. The contacting segment 194 is mounted on and protrudes from the top face of the base 192.

The connecting relationship between the contact layer 19 and the mounting seat 15 can enable the contact layer to assemble or disassemble on the mounting seat 15 quickly and easily. Then, the contact layer 19 can be assembled, replaced and removed to clean quickly and conveniently. Furthermore, when the contact layer 19 is mounted in the mounting seat 15, the middle section of contacting segment 194, 194*a* of the contact layer 19 protrudes upwardly from the mounting seat 15 by the protruding segment 151, 151*a* as shown in FIGS. 4 and 5B. This can provide a preferred scraping effect to the quick assembling floor mat in accordance with the present invention.

The connecting strips 20 are bar-shaped and are detachably connected to the reinforced plastic bars 10. Each connecting strip 20 has two sides, a top face, a bottom face, two enlarged ends 22 and multiple through holes 24. The enlarged ends 22 are respectively formed on and protrude from the sides of the connecting strip 20 and correspond to the connecting grooves 18 of two adjacent reinforced plastic bars 10. The through holes 24 are formed through the top face and the bottom face of the connecting strip 20 at intervals between the enlarged ends 22. When the quick assembling floor mat in accordance with the present invention is used, the through holes 24 of the connecting strips 20 can prevent mud or dirt from remaining on the connecting strips 20 to provide a dirt-excluding effect to the quick assembling floor mat. Preferably, the connecting strip 20 can be made of plastic or rubber. For example, in order to make the quick assembling floor mat in accordance with the present invention to be deflected and stored conveniently, the connecting strips 20 are made of high tension, high structural strength and flexible material such as high density polyethylene or rubber.

Figure 6:
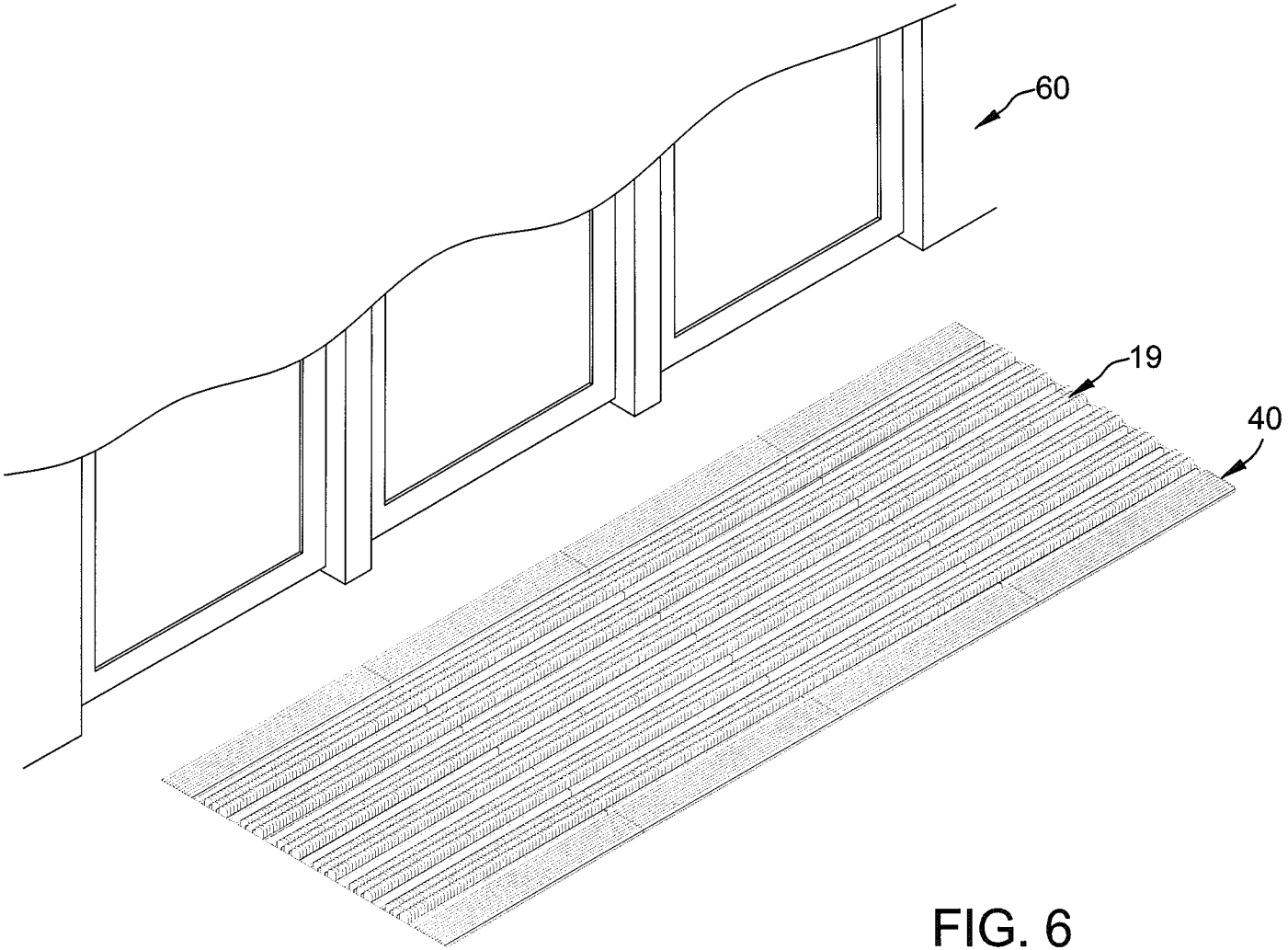
FIG. 6 is an operational perspective view of the quick assembling floor mat in FIG. 1, placed at an entrance of a building.
Figure 7:
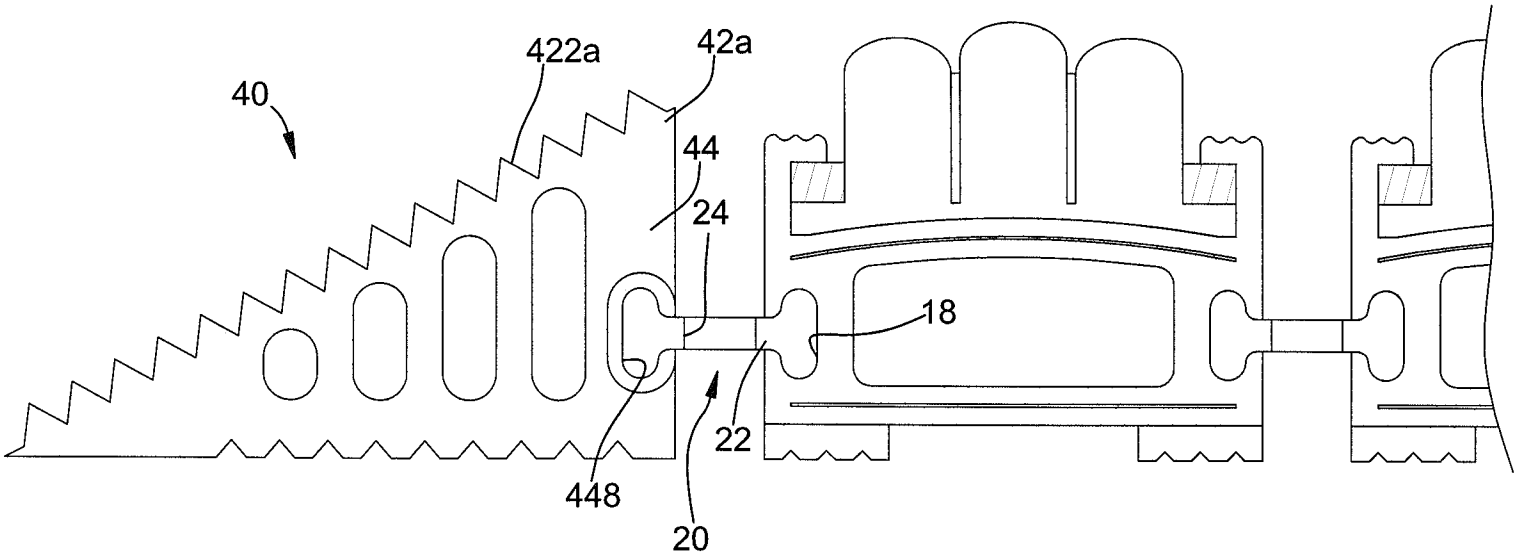
FIG. 7 is an enlarged side view of a second embodiment of the sealing bar of the quick assembling floor mat in accordance with the present invention.
Figure 8:
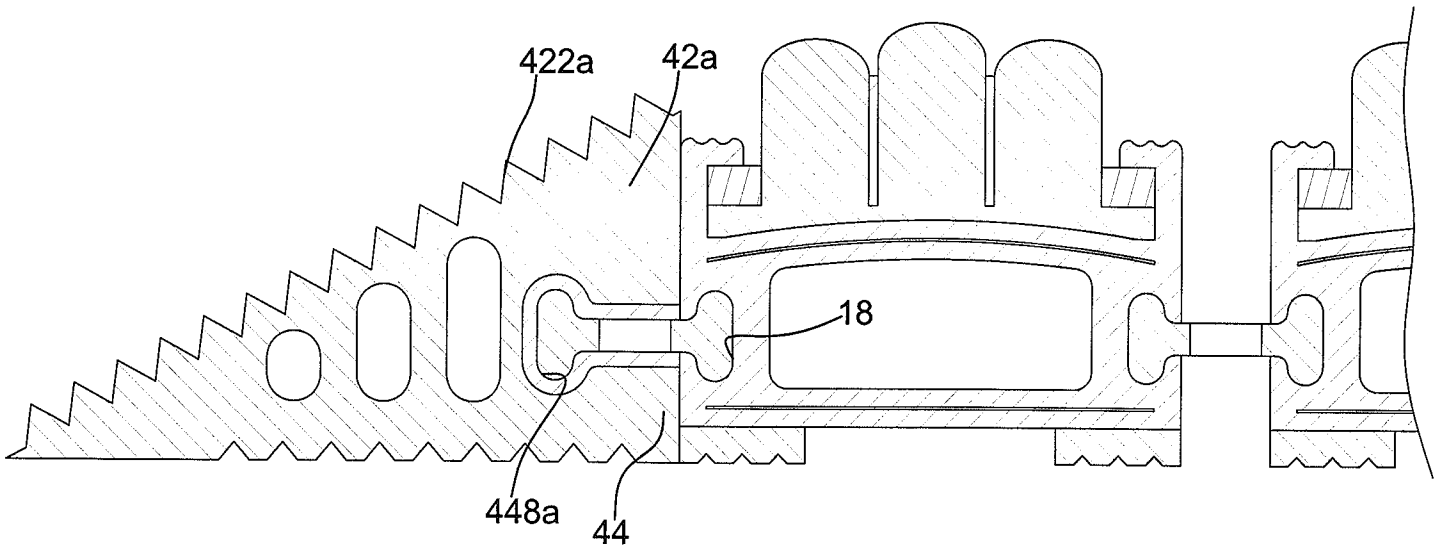
FIG. 8 is an enlarged side view of a third embodiment of the sealing bar of the quick assembling floor mat in accordance with the present invention.

With reference to FIGS. 4 and 6 to 8, the at least one sealing bar 40 is connected to one of connecting strips 20, may be a local hollow soft strip or may be made of a partial hollow rigid metal or plastic material. The cross-section of the at least one sealing bar 40 can be made according to the user's need and can be a rectangular shape as shown in FIG. 4 or a triangular shape as shown in FIGS. 7 and 8. The at least one sealing bar 40 has a sealing body 42, 42*a* and at least one connecting segment 44. The sealing body 42, 42*a* is connected to one of the connecting strips 20 and has a cross section, two sidewalls, a top face and multiple scraping recesses 422. The cross section of the sealing body 42, 42*a* may be a rectangular shape or a triangular shape. The scrapping recesses are V-shaped and are formed in the top face of the sealing body 42, 42*a*. This can provide the at least one sealing bar with a preferred mud-scraping effect and anti-slip effect to the quick assembling floor mat.

The at least one connecting segment 44 is formed in one of the sidewalls of the sealing body 42, 42*a* as a single piece and has a connecting slot 448, 448*a*. The connecting slot 448, 448*a* is formed through the corresponding sidewall of the sealing body 42, 42*a* and corresponds to the connecting grooves 18 of the reinforced plastic bar 10. The at least one sealing bar 40 is connected to one of the reinforced plastic bars 10 by the enlarged ends 22 of one of the connecting strips 20 respectively inserting into the connecting slot 448, 448*a* of the at least one connecting segment 44 and one of the connecting grooves 18 of the corresponding reinforced plastic bar 10.

Additionally, the sealing body 42, 42*a* and the at least one connecting segment 44 can be made of the same material or different material. For example, the hardness of the connecting segment 44 is softer than the hardness of the sealing body 42, 42*a* to form the connecting slot 448, 448*a* easily. Furthermore, the depth of the connecting slot 448, 448*a* of the at least one connecting segment 44 can be different to meet the user's need. When the enlarged ends 22 of one of the connecting strips 20 are respectively mounted in the connecting slot 448, 448*a* of the at least one connecting segment 44 of the at least one sealing bar 40 and one of the connecting grooves 18 of a corresponding reinforced plastic bar 10 and if the depths of the connecting slot 448, 448*a* and the corresponding connecting groove 18 are narrower than the width of the corresponding connecting strip 20, a gap is formed between the at least one sealing bar 40 and the corresponding reinforced plastic bar 10 as shown in FIGS. 4 and 7. If the depths of the connecting slot 448, 448*a* and the corresponding connecting groove 18 are wider than the width of the corresponding connecting strip 20, the whole corresponding connecting strip 20 is mounted in the connecting slot 448, 448*a* and the corresponding connecting groove 18, and there is no gap formed between the at least one sealing bar 40 and the corresponding reinforced plastic bar 10 as shown in FIG. 8. When the whole corresponding connecting strip 20 is mounted in the connecting slot 448, 448*a* and the corresponding connecting groove 18, the aesthetics of the quick assembling floor mat can be enhanced, and the integrity and strength of the quick assembling floor mat also can be strengthened.

With further reference to FIG. 6, the quick assembling floor mat in accordance with the present invention can be securely mounted on the ground in front of an entrance 60 of a building. When a user walks across the quick assembling floor mat, mud and dirt mounted on the sole can be scraped by the contact layers 19 of the reinforced plastic bars 10 and the scraping recesses 422 of the at least one sealing bar 40 to maintain the cleanliness of the building. Additionally, two sealing bars 40 are respectively connected to the two outermost reinforced plastic bars 10 as shown in FIG. 6.

Figure 9:
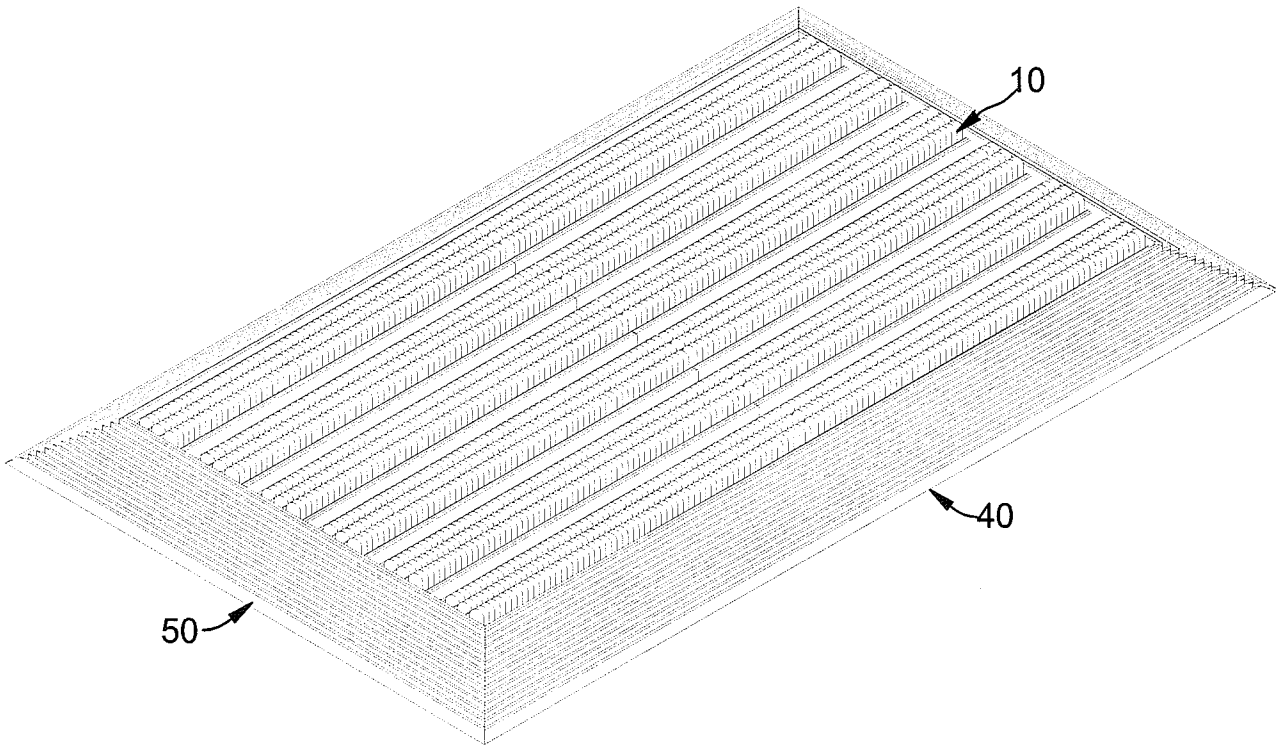
FIG. 9 is a perspective view of a second embodiment of a quick assembling floor mat in accordance with the present invention.
Figure 10:
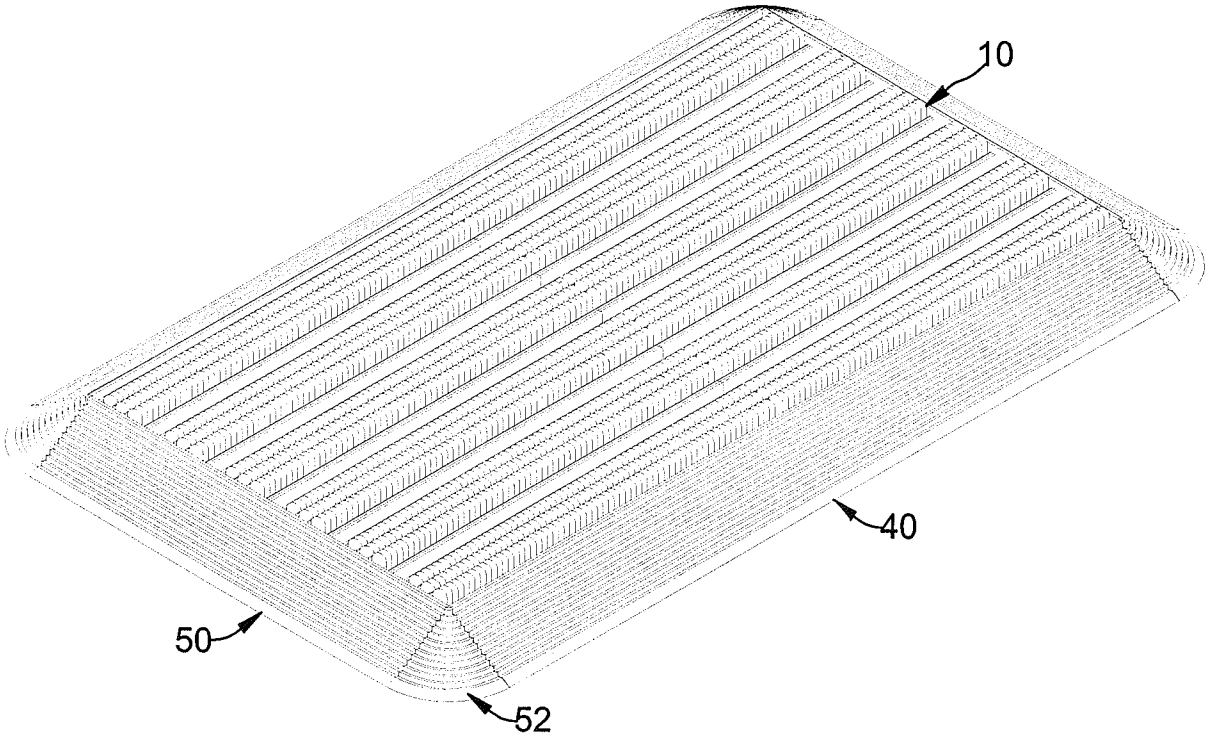
FIG. 10 is a perspective view of a third embodiment of a quick assembling floor mat in accordance with the present invention.

With reference to FIG. 9, the quick assembling floor mat in accordance with the present invention further has two side sealing bars 50. The side sealing bars 50 are connected to the two sealing bars 40 and the reinforced plastic bars 10 by sticking or engaging, and this can make the reinforced plastic bars 10 be surrounded by the side sealing bars 50 and the sealing bars 40. In addition, with reference to FIG. 10, the quick assembling floor mat in accordance with the present invention further has four corner elements 52 connected to the sealing bars 40 and the side sealing bars 50, and this can prevent the user getting hurt from the sharp corners in FIG. 9.

The quick assembling floor mat in accordance with the present invention as described has the following advantages.

1. The reinforced plastic bars 10 in the present invention only use a small amount of a metal material to reinforce, and this can reduce the cost of materials and can maintain the rigidity and the intensity of the quick assembling floor mat.

2. The quick assembling floor mat in accordance with the present invention is made of plastic and metal by extruding, and the quick assembling floor mat can be cut according to the user' need easily to enhance the convenience of the construction.

3. The connecting strips 20 of the quick assembling floor mat in accordance with the present invention are flexible, and this enables the quick assembling floor mat to be deflected and stored easily and conveniently. In addition, the cleaning staff also can take the quick assembling floor mat from the ground to clean the mud and dirt below the quick assembling floor mat conveniently.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A quick assembling floor mat comprising:

multiple reinforced plastic bars, with each reinforced plastic bar having:

a body being rectangular in cross-section, being made of plastic and having a length, a bottom surface, a top surface, two sidewalls and a through chamber formed through the body between the top surface, the bottom surface and the two sidewalk of the body;

a mounting seat formed on the to the body, wherein the mounting seat is a U-shaped track in cross-section, wherein the mounting seat has a bottom surface, a middle section and a protruding segment formed on and protruding from the bottom surface of the mounting seat at the middle section of the mounting seat;

at least one metal reinforcing sheet mounted in the body selectively between the top surface and the through chamber of the body or the bottom surface and the through chamber of the body to enhance the structural strength of the body, wherein an uppermost metal reinforcing sheet is curved corresponding to the middle section of the mounting seat to form the protruding segment of the mounting seat;

two connecting grooves respectively formed in the two sidewalls of the body, with each connecting groove having:

a mouth formed through the corresponding sidewall of the body and communicating with the connecting groove; and a length corresponding to or shorter than the length of the body; and a contact layer detachably mounted in the mounting seat and being rough to scrape mud and dirt; and multiple connecting strips, with each one of the multiple connecting strips connected to two adjacent reinforced plastic bars and having:

two sides; and two enlarged ends respectively formed on and protruding from the two sides of the connecting strip and corresponding to the two connecting grooves of the two adjacent reinforced plastic bars.

2. The quick assembling floor mat as claimed in claim 1, wherein each reinforced bar has at least one sound-absorbing layer securely mounted on the bottom surface of the body by bonding, engagement or integrally molding.

3. The quick assembling floor mat as claimed in claim 2, wherein each reinforced bar has two sound-absorbing layers mounted on the bottom surface of the body at an interval, with each one of the two sound-absorbing layers being bar-shaped and formed on the body integrally via an extruding process and having a hardness softer than a hardness of the body.

4. The quick assembling floor mat as claimed in claim 3, wherein each reinforcing plastic bar has two metal reinforced sheets integrally mounted in the body beside the through chamber of the body to form a single piece.

5. The quick assembling floor mat as claimed in claim 4, wherein the mounting seat is formed by a mold used to manufacture the body to thicken the middle section of the mounting seat to form the protruding segment.

6. The quick assembling floor mat as claimed in claim 1, wherein the contact layer is made of carpet, non-woven cloth, rubber, foam cushioning material, metal, or a plastic brush and has:

a base movably mounted in the mounting seat and abutting the protruding segment; and a contacting segment mounted on and protruding from a top face of the base.

7. The quick assembling floor mat as claimed in claim 6, wherein each connecting strip is made of high tension, high structural strength and flexible material and has a top face, a bottom face and multiple through holes formed through the top face and the bottom face of the connecting strip at intervals between the two enlarged ends.

8. The quick assembling floor mat as claimed in claim 6, further comprising at least one sealing bar connected to one of the multiple connecting strips, being a local hollow soft strip or being made of a partial hollow rigid metal or plastic material, and wherein the at least one sealing bar has a rectangular shape or a triangular shape in cross section and a connecting slot corresponding to one of the two connecting grooves of the corresponding connecting strip.

9. The quick assembling floor mat as claimed in claim 8, wherein:

the two enlarged ends of one of the multiple connecting strips are respectively mounted in the connecting slot of the at least one sealing bar and one of the two connecting grooves of a corresponding reinforced plastic bar;

the depths of the connecting slot and the corresponding connecting groove are the same as the width of the corresponding connecting strip;

the whole corresponding connecting strip is mounted in the connecting slot and the corresponding connecting groove;

the at least one sealing bar abuts the corresponding reinforced plastic bar; and the at least one sealing bar has:

a top face; and multiple crapping recesses being V-shaped and formed in the top face of the at least one sealing bar.

10. The quick assembling floor mat as claimed in claim 8, further comprising:

two sealing bars respectively connected to the two outermost reinforced plastic bars;

two side sealing bars connected to the reinforced plastic bars; and four corner elements connected to the two sealing bars and the two side sealing bars to surround the reinforced plastic bars.

11. A reinforced plastic bar for a quick assembling floor mat, comprising:

a body being rectangular in cross-section, being made of plastic and having a length, a bottom surface, a top surface, two sidewalls and a through chamber formed through the body between the top surface, the bottom surface and the two sidewalls of the body;

a mounting seat formed on the top surface of the body, wherein the mounting seat is a U-shaped track in cross-section and has a bottom surface, a middle section and a protruding segment formed on and protruding from the bottom surface of the mounting seat at the middle section of the mounting seat;

at least one metal reinforcing sheet mounted in the body selectively between the top surface and the through chamber of the body or the bottom surface and the through chamber of the body to enhance the structural strength of the body, wherein an uppermost metal reinforcing sheet is curved corresponding to the middle section of the mounting seat to form the protruding segment of the mounting seat; and at least one connecting groove formed in one of the two sidewalls of the body, and having:

a mouth formed through the corresponding sidewall of the body and communicating with the connecting groove; and a length corresponding to or shorter than the length of the body.

12. The reinforced plastic bar for a quick assembling floor mat as claimed in claim 11, wherein the reinforced plastic bar has:

a contact layer detachably mounted in the mounting seat and being rough to scrape mud and dirt; and at least one sound-absorbing layer securely mounted on the bottom surface of the body by bonding, engagement or integrally molding.

13. The reinforced plastic bar for a quick assembling floor mat as claimed in claim 12, wherein the reinforced bar has two sound-absorbing layers mounted on the bottom surface of the body at an interval, with each one of the two sound-absorbing layers being bar-shaped and formed on the body integrally via an extruding process and having a hardness softer than a hardness of the body.

14. The reinforced plastic bar for a quick assembling floor mat as claimed in claim 13, wherein the reinforced plastic bar has two metal reinforcing sheets integrally mounted in the body beside the through chamber of the body to form a single piece.

15. The reinforced plastic bar for a quick assembling floor mat as claimed in claim 14, wherein the contact layer is made of carpet, non-woven cloth, rubber, foam cushioning material, metal or a plastic brush and has:

a base movably mounted in the mounting seat and abutting the protruding segment; and a contacting segment mounted on and protruding from a top face of the base.

16. The reinforced plastic bar for a quick assembling floor mat as claimed in claim 13, wherein the mounting seat is formed by a mold used to manufacture the body to thicken the middle section of the mounting seat to form the protruding segment.

* * * * *